US008459536B2

(12) United States Patent
Hanna

(10) Patent No.: US 8,459,536 B2
(45) Date of Patent: Jun. 11, 2013

(54) NESTING CATERING TRAY CONTAINER

(75) Inventor: David Matthew Hanna, Galesburg, MI (US)

(73) Assignee: Arvco Container Corporation, Kalamazoo, MI (US)

( * ) Notice: Subject to any disclaimer, the term of this patent is extended or adjusted under 35 U.S.C. 154(b) by 646 days.

(21) Appl. No.: 12/152,382

(22) Filed: May 14, 2008

(65) Prior Publication Data

US 2008/0296358 A1 Dec. 4, 2008

Related U.S. Application Data

(60) Provisional application No. 60/932,316, filed on May 30, 2007.

(51) Int. Cl.
*B65D 5/66* (2006.01)
*B65D 5/64* (2006.01)

(52) U.S. Cl.
USPC ..... 229/128; 206/557; 220/23.87

(58) Field of Classification Search
USPC ..... 229/128, 126, 114, 153; 206/505, 206/506, 507, 512, 514, 784, 153
See application file for complete search history.

(56) References Cited

U.S. PATENT DOCUMENTS

| | | | | | |
|---|---|---|---|---|---|
| 1,725,524 | A | * | 8/1929 | Kondolf | 229/176 |
| 2,536,948 | A | * | 1/1951 | Lehman | 229/150 |
| 3,310,219 | A | | 3/1967 | Dlugopolski | |
| 3,618,848 | A | * | 11/1971 | Pawlowski et al. | 206/784 |
| 3,917,155 | A | | 11/1975 | Bemiss | |
| 4,265,393 | A | | 5/1981 | Orchard | |
| 5,092,467 | A | * | 3/1992 | Elward | 206/784 |
| 5,494,214 | A | * | 2/1996 | Fleury et al. | 229/149 |
| 5,839,652 | A | * | 11/1998 | Ben-Haim | 229/240 |
| 5,921,466 | A | | 7/1999 | Speese et al. | |
| 6,065,669 | A | | 5/2000 | Correll | |
| 6,676,010 | B1 | * | 1/2004 | Roseth et al. | 229/114 |
| 6,729,533 | B2 | | 5/2004 | Wozniacki | |
| 7,004,379 | B2 | * | 2/2006 | Holdsworth et al. | 229/164 |
| 7,234,629 | B2 | | 6/2007 | Ho | |
| 2005/0236294 | A1 | | 10/2005 | Herbert et al. | |

* cited by examiner

*Primary Examiner* — Nathan J Newhouse
*Assistant Examiner* — Christopher Demeree
(74) *Attorney, Agent, or Firm* — Flynn, Thiel, Boutell & Tanis, P.C.

(57) ABSTRACT

A container formed from a foldable blank into a box-like configuration for transport of a tray or container storing food items therein, such as a catering tray. The container includes a bottom portion defined by a bottom wall, front and rear walls, and spaced-apart side walls, all of which project upwardly from bottom wall. A top portion is provided which is swingably movable relative to the bottom portion to provide open and closed configurations of the container. The container provides an added insulative layer so as to maintain food items stored within the catering tray at the desired temperature, and also improves handling thereof.

19 Claims, 7 Drawing Sheets

NESTING CATERING TRAY CONTAINER

CROSS-REFERENCE TO RELATED APPLICATION

This application claims the benefit of U.S. Provisional Application Ser. No. 60/932,316, filed May 30, 2007, which is incorporated herein by reference in its entirety.

FIELD OF THE INVENTION

This invention relates to an improved container assembled from a foldable blank and designed specifically for housing and transporting a catering tray or container.

BACKGROUND OF THE INVENTION

Trays or pan-shaped containers are often utilized to transport food products for catering, delivery or other purposes. These trays typically have a bottom portion defined by a bottom wall and sidewalls which project upwardly from the bottom wall. A flange is defined along the upper extent of the sidewalls, which flange projects generally horizontally sidewardly outwardly from the respective sidewalls. A flexible cover, for example of aluminum foil, plastic or other material, is typically used to cover and close off the open upper end of the bottom portion by folding or crimping the edges of the cover over the sidewall flanges.

The above trays are utilized to transport both hot and cold food items, and thus it is desirable to provide additional insulation so as to maintain the food item at the proper temperature. Further, when the above trays are utilized to transport hot foods, the trays can become difficult to handle, and thus an added insulative layer between the tray and the handler would be desirable. In addition, the above trays, when constructed of flexible materials such as aluminum, may not possess adequate rigidity for safe handling, and thus it is desirable to provide such trays with additional rigidity to further improve handling.

Accordingly, it is an object of the present invention to provide an improved container for covering, insulating and rigidifying conventional catering or delivery trays or pans.

The container according to the invention is formed by being folded from a flat blank. The blank according to the invention is formed of corrugated cardboard, and when partially folded or assembled is capable of being nested so as to conserve space during storage thereof. The resulting container is stable and rigid and allows for safe handling and transport of the tray therein, and also provides an additional layer of insulation so as to preserve the targeted food temperature.

More specifically, the container includes upper and lower portions, wherein the upper portion is pivotable away from and toward the lower portion to respectively define open and closed configurations of the container. The lower portion has a generally planar bottom wall from which a front wall and a pair of sidewalls project upwardly. A generally upright rear wall projects upwardly from a rear edge of the bottom wall, and hingedly connects the upper portion of the container to the lower portion. Upper portion includes a generally planar top wall and a front flap which mounts thereon a pair of locking flaps which engage with the respective sidewalls to secure the container in the closed configuration. The front wall, rear wall, and sidewalls diverge or angle outwardly as same project upwardly from the bottom wall, to allow nesting of multiple containers for storage. Further, the container is sized such that the lower portion of the catering tray fits wholly within the lower portion of the container, and the upper flange of the catering tray seats atop upper edges of the opposite sidewalls which maintains the tray securely within the container, and provides added rigidity to the tray.

Other objects and purposes of the invention will be apparent to persons familiar with arrangements of this general type upon reading the following specification and inspecting the accompanying drawings.

Figure 1:
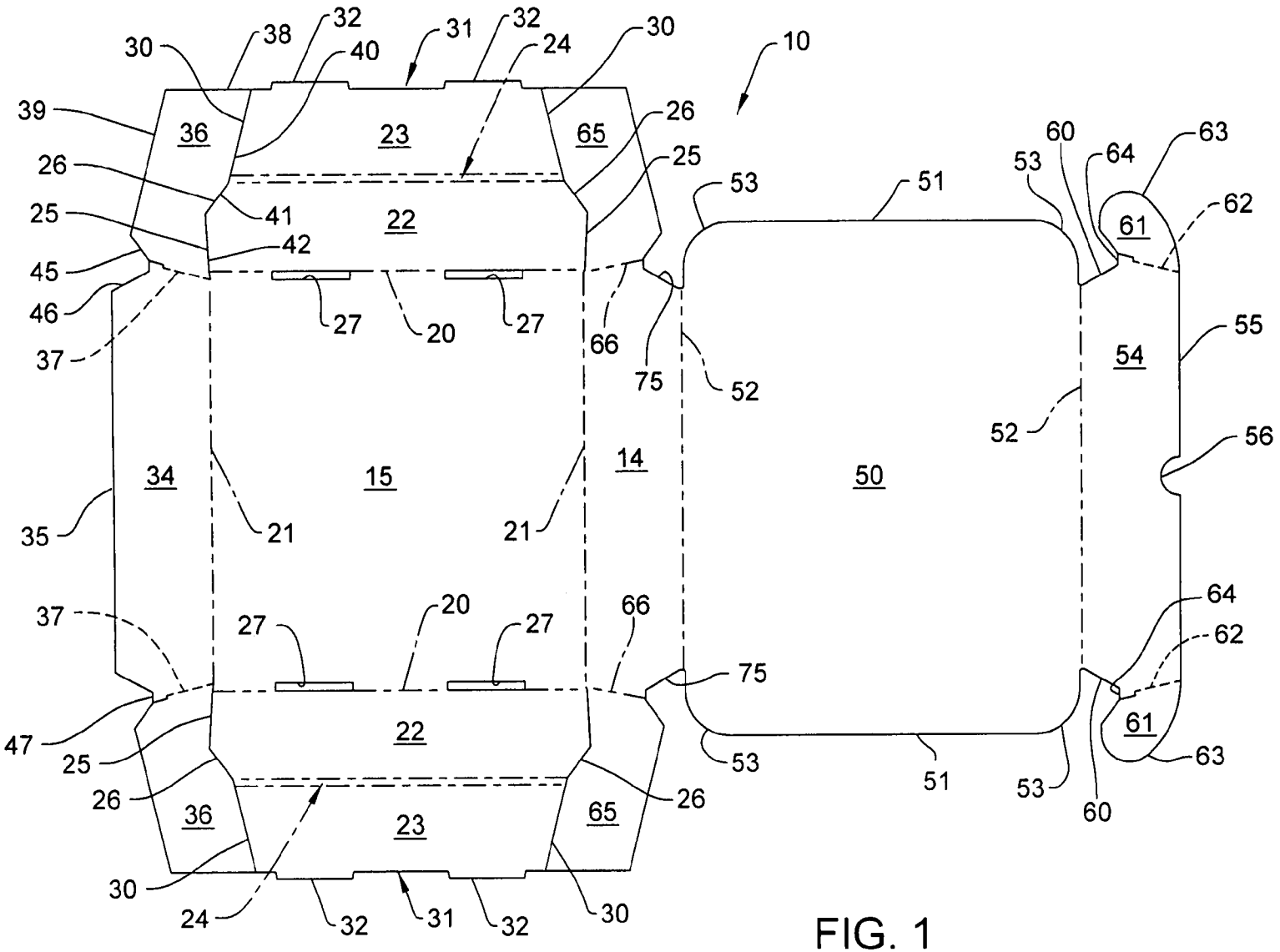
FIG. 1 is a plan view of an unfolded flat blank according to the present invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the container or blank and designated parts thereof. Said terminology will include the words specifically mentioned, derivatives thereof, and words of similar import.

DETAILED DESCRIPTION

Referring to FIG. 1, the present invention is directed to a flat blank 10, which in the illustrated embodiment is constructed from corrugated cardboard. The corrugated cardboard may be of the type which is double-sided with a corrugated interior layer bonded between a pair of flat facing layers, which layers are all of rather thin paper. However, the blank 10 may also be constructed of single-sided corrugated cardboard having a corrugated layer bonded to a single flat facing layer, with the corrugated layer facing inwardly. The blank 10 is prepared using techniques which are conventional and well-known in the box-forming industry.

The blank 10 is foldable into the shape of a box or container 11 (FIG. 2) suitable for carrying a further tray, box or container which itself carries a food product or item. The container 11 includes upper and lower portions 12 and 13 which are joined together by a rear base portion 14 so as to permit closure of the container 11 and creation of a closed compartment therein.

The blank 10 is a flat and generally planar, monolithic, one-piece element and defines a bottom wall 15 which forms part of the lower portion 13 and in the illustrated embodiment has a generally rectangular shape. The bottom wall 15 has a pair of generally parallel first side edges 20 and a pair of generally parallel second side edges 21, the latter extending generally perpendicularly between the side edges 20. All of the side edges 20 and 21 are defined by fold lines as shown in dotted lines in FIG. 1.

The blank 10 also includes a pair of elongate inner sidewall parts 22 which join to opposite edges 20 at the fold lines thereof. Each inner sidewall part 22 is joined to an outer sidewall part 23 via a double fold line 24 which is parallel to fold line 20. When the container 11 is assembled as discussed below, the double fold lines 24 form a horizontally oriented surface 24A located at the uppermost edge of each sidewall part 22. Each inner sidewall part 22 includes a pair of spaced-apart side edges 25 which originate at a junction between fold lines 20 and 21 and angle slightly outwardly as same project away from said junction. Each inner sidewall part 22 further includes a pair of spaced-apart upper edges 26 which extend from the outer edge of the respective adjacent edge 25 and project inwardly at an angle towards double fold line 24. In the illustrated embodiment, a pair of generally rectangular cut-outs 27 are defined in bottom wall 15 in a spaced-apart manner along each respective fold line 20.

Each outer sidewall part 23 includes a pair of side edges 30 which originate at the respective fold line 24 and angle inwardly and towards one another as same project away from fold line 24. The sidewall part 23 defines an outer free edge 31 which is generally parallel to fold line 24, and a pair of locking tabs 32 are cantilevered outwardly from free edge 31 in horizontally spaced-apart relation with one another in alignment with the respective cutouts 27.

The blank 10 additionally includes a front wall 34 joined to the front side of bottom wall 15 via fold line 21. Front wall 34 has an outer free edge 35 which is generally parallel to fold line 21. A pair of side flaps 36 are joined to opposite edges of front wall 34 via fold lines 37. Fold lines 37 at their inner ends originate at fold line 21 defined between front wall 34 and bottom wall 15 and diverge away from one another as same project outwardly. Each side flap 36 has an outer free edge 38 which is coextensive with free edge 31 of the adjacent outer side wall part 23, and a further sidewardly-oriented free edge 39 which intersects edge 38 and is generally parallel with adjacent edge 30 of outer sidewall part 23. Each of the respective side flaps 36 additionally includes an inner free edge defined by a cut line which conforms to and defines edges 30, 26 and 25 and separates the respective flap 36 from the adjacent outer and inner wall parts 23 and 22. Thus, this inner free edge of the flap 36 includes edge 40 disposed adjacent edge 30, edge 41 disposed adjacent edge 26, and edge 42 disposed adjacent edge 25. Flaps 36 additionally define an angled edge 45 which projects inwardly from the adjacent free edge 39 and terminates at fold line 37. Front wall 34 defines a pair of angled edges 46 at opposite sides thereof, which edges 46 angle inwardly from front wall free edge 35 and terminate at the respective fold lines 37. Adjacent edges 45 and 46 join one another at a flat 47.

The upper portion 12 of blank 10 is embodied by a top wall 50 having a generally rectangular configuration. In the illustrated embodiment, top wall 50 is somewhat larger than bottom wall 15, and includes a pair of generally parallel first side edges 51 and a pair of generally parallel second side edges 52, the latter extending generally perpendicularly between the side edges 51. Side edges 51 are generally parallel to, but outwardly offset from, the respective fold lines 20 of bottom wall 15. Side edges 52 are both defined by fold lines as shown in dotted lines, and are generally parallel to fold lines 21 of bottom wall 15. Edges 51 and 52 join to one another at four rounded edges 53 of top wall 50.

With continued reference to FIG. 1, the top wall 50 is joined to rear base portion 14 along innermost edge 52 via a fold line. The opposite or outermost edge 52 of top wall 50 is joined a top front flap 54. Top front flap 54 includes an outer free edge 55 defining a semi-circular cutout 56 approximately midway therealong. Cutout 56 effectively defines a finger grip which can be utilized to open the container 11. Top front flap 54 additionally includes a pair of inner angled edges 60 on opposite sides thereof, which angled edges 60 originate at fold line 52 and diverge away from one another as same project towards free edge 55. A pair of side locking flaps 61 are disposed at opposite sides of top front flap 54 and are joined thereto via respective fold lines 62. Each side flap 61 defines an outer and generally rounded free edge 63 which interconnects free edge 55 and angled edge 60. A flat 64 is defined between each edge 63 and adjacent edge 60.

Rear base wall 14 is joined to a pair of side flaps 65 at opposite sides thereof via respective fold lines 66. Each fold line 66 originates at the junction of fold lines 20 and 21 and angle away from one another as same project towards top wall 50. Side flaps 65 are mirror images of the respective side flaps 36, and will accordingly not be described in detail. Rear wall 14 includes a pair of angled edges 75 which originate at the respective fold lines 66 and angle inwardly as same project towards top wall 50.

The blank will normally be maintained in the flat condition illustrated by FIG. 1, which facilitates compact shipping and storage thereof. When use is desired, the blank 10 may be assembled for the purpose of stacking and nesting a number of containers 11 atop one another in readiness for use as discussed below, and then folded into a closed position for transport and handling of a tray or container 70 for storing and transporting food items.

Figure 4:
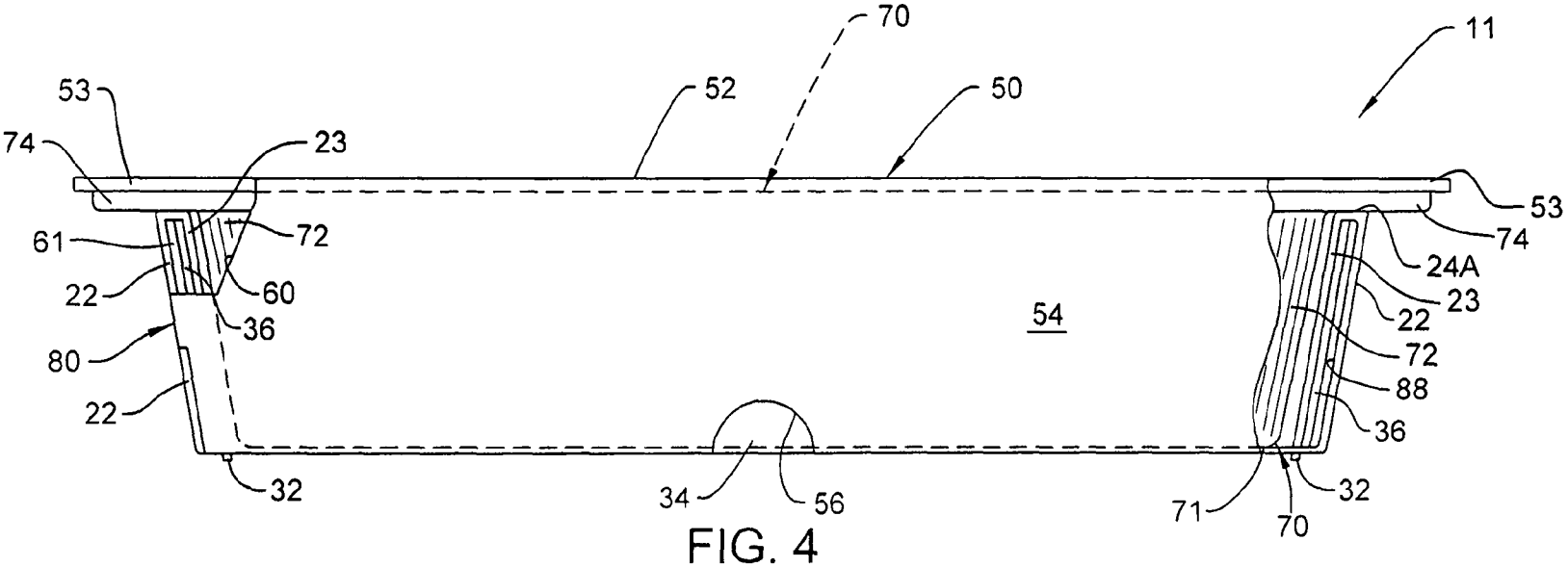
FIG. 4 is an elevational front view of the container in a closed configuration with a food tray stored within the container, and with a portion of the front wall of the container broken away.
Figure 5:
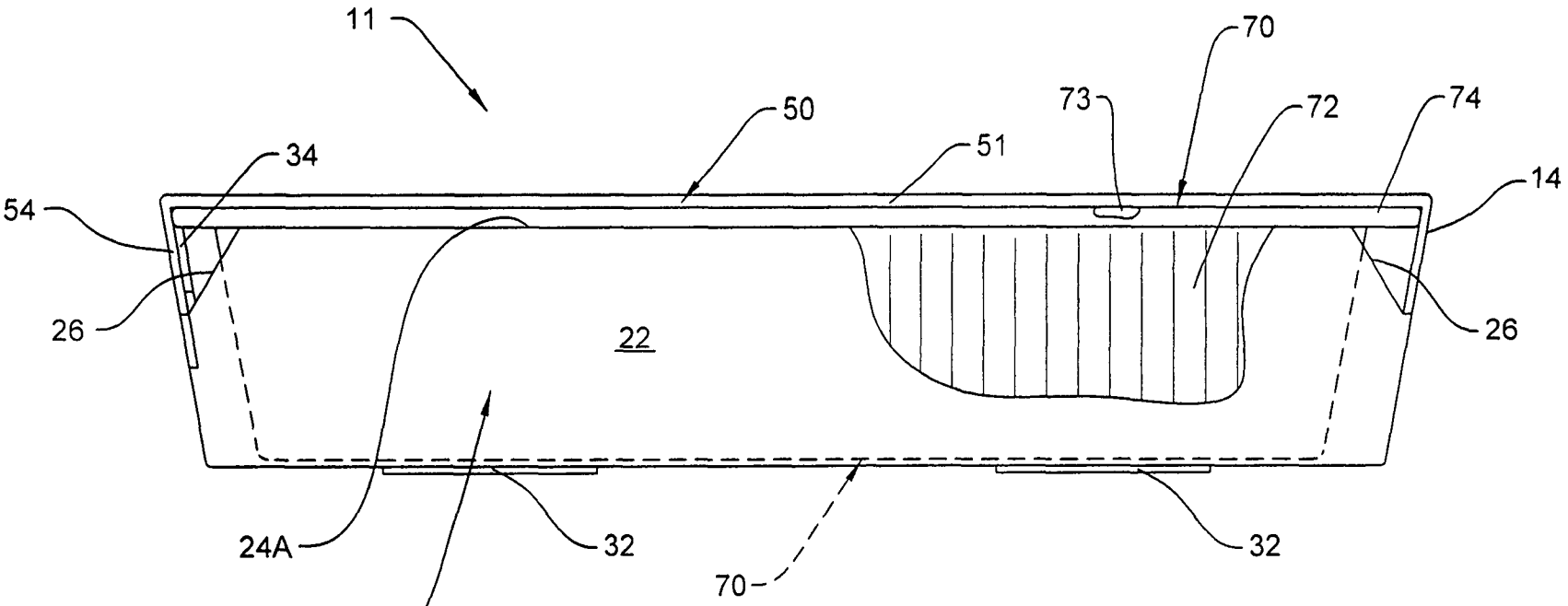
FIG. 5 is an elevational side view of the container in a closed configuration with a food tray stored within the container, and with a portion of the sidewall of the container broken away.
Figure 6:
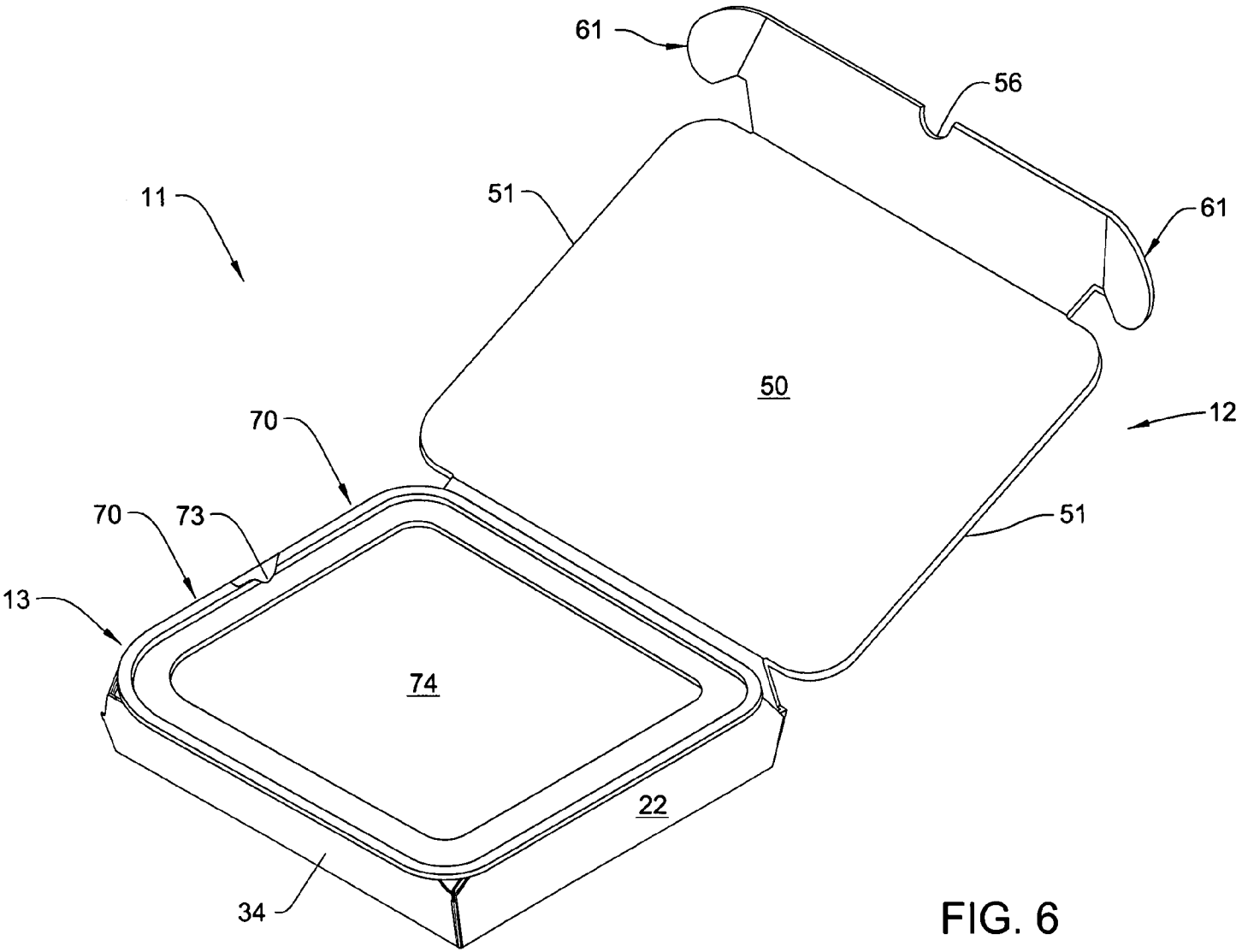
FIG. 6 is an overhead perspective view similar to FIG. 2, but with a food tray stored within the container.

As shown in FIGS. 4-6, tray 70 in the illustrated embodiment is of an upwardly-opening construction defined by a bottom wall 71 and sidewalls 72 which together define an interior upwardly-opening compartment. The sidewalls 72 are generally upright, and may be oriented perpendicularly relative to the bottom wall 71 or may diverge outwardly as same project upwardly from bottom wall 71. Tray 70 further includes a flange 73 (FIG. 5), which in the illustrated embodiment is integrally formed with the respective sidewalls 72. Flange 73 is cantilevered sidewardly from the respective sidewalls 72 so as to define a continuous ring-shaped configuration. A cover 74 is then utilized to close off the compartment defined by the bottom wall 71 and sidewalls 72 of tray 70. In this regard, cover 74 may be constructed of a flexible sheet of metal, such as aluminum, and the outer edges of the sheet are folded over the flange 73 around the perimeter of the container 74 to close and seal same. Bottom wall 71 and sidewalls 72 in the illustrated embodiment are constructed of aluminum.

It will be appreciated that tray 70 may have other configurations and may be constructed of other materials than those described above, and that the above description is presented only as one example of the type of container or tray which may be utilized with the present invention.

To partially assemble the container 11 for purposes of stacking a plurality of such containers 11 in nested relationship (FIG. 3), sidewall parts 22 are initially manually folded upwardly about fold lines 20, and the rear base portion 14 and front wall 34 are manually folded upwardly about their respective fold lines 21. The opposite pairs of side flaps 36 and 65 are then folded inwardly about their respective fold lines 37 and 66 towards one another until their lower edges lie substantially along the adjacent fold line 20. Each outer sidewall part 23 is then folded downwardly about its respective fold line 24 and over the flaps 36 and 65, and the tabs 32 thereof tucked into the respective slots 27 defined in bottom wall 15. Thus, in the folded configuration described above, flaps 36 and 65 are sandwiched between inner and outer sidewall parts 22 and 23 and therewith form multi-layered sidewalls 80.

Figure 2:
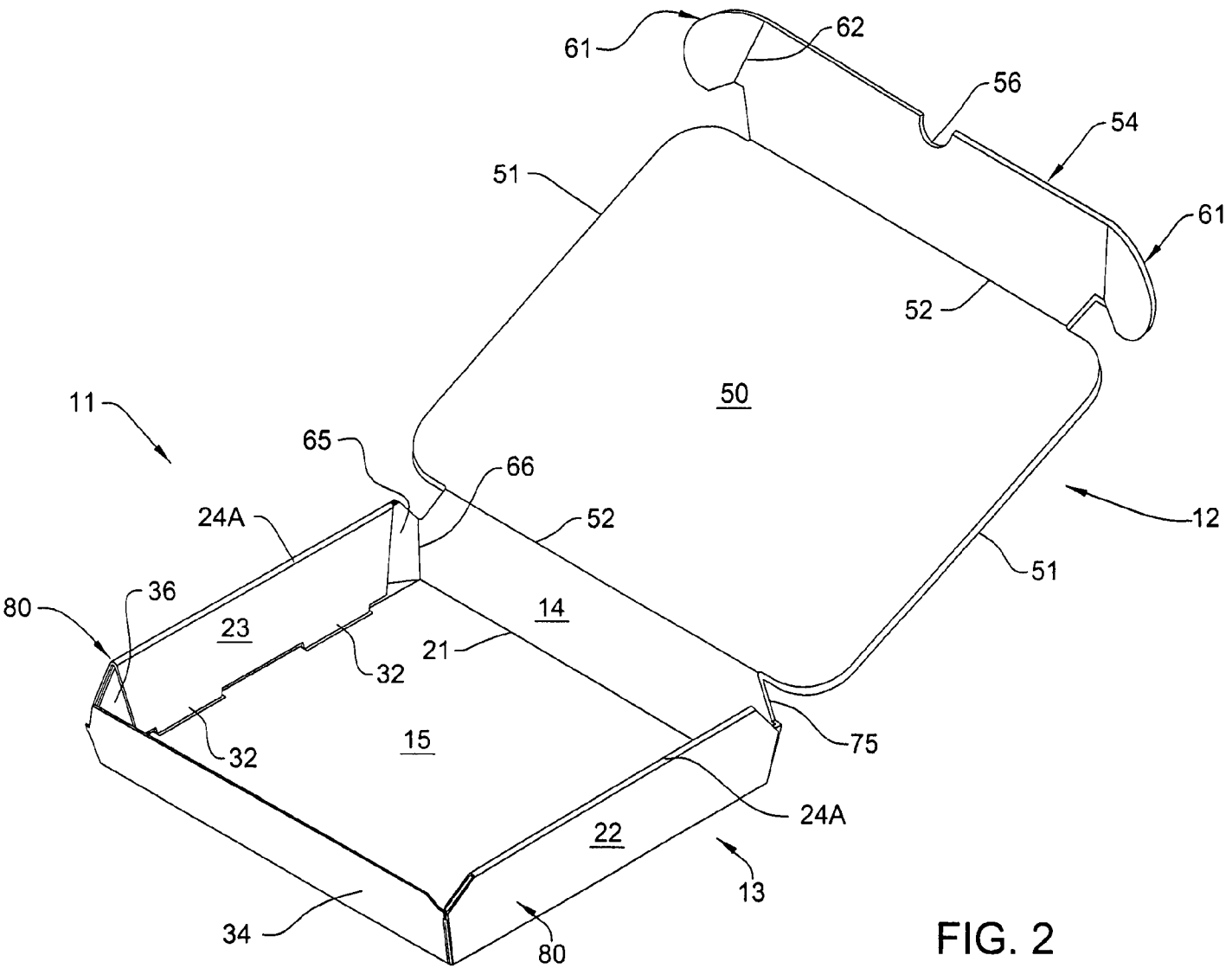
FIG. 2 is an overhead perspective view of an assembled container formed from the blank of FIG. 1 in an open configuration.
Figure 3:
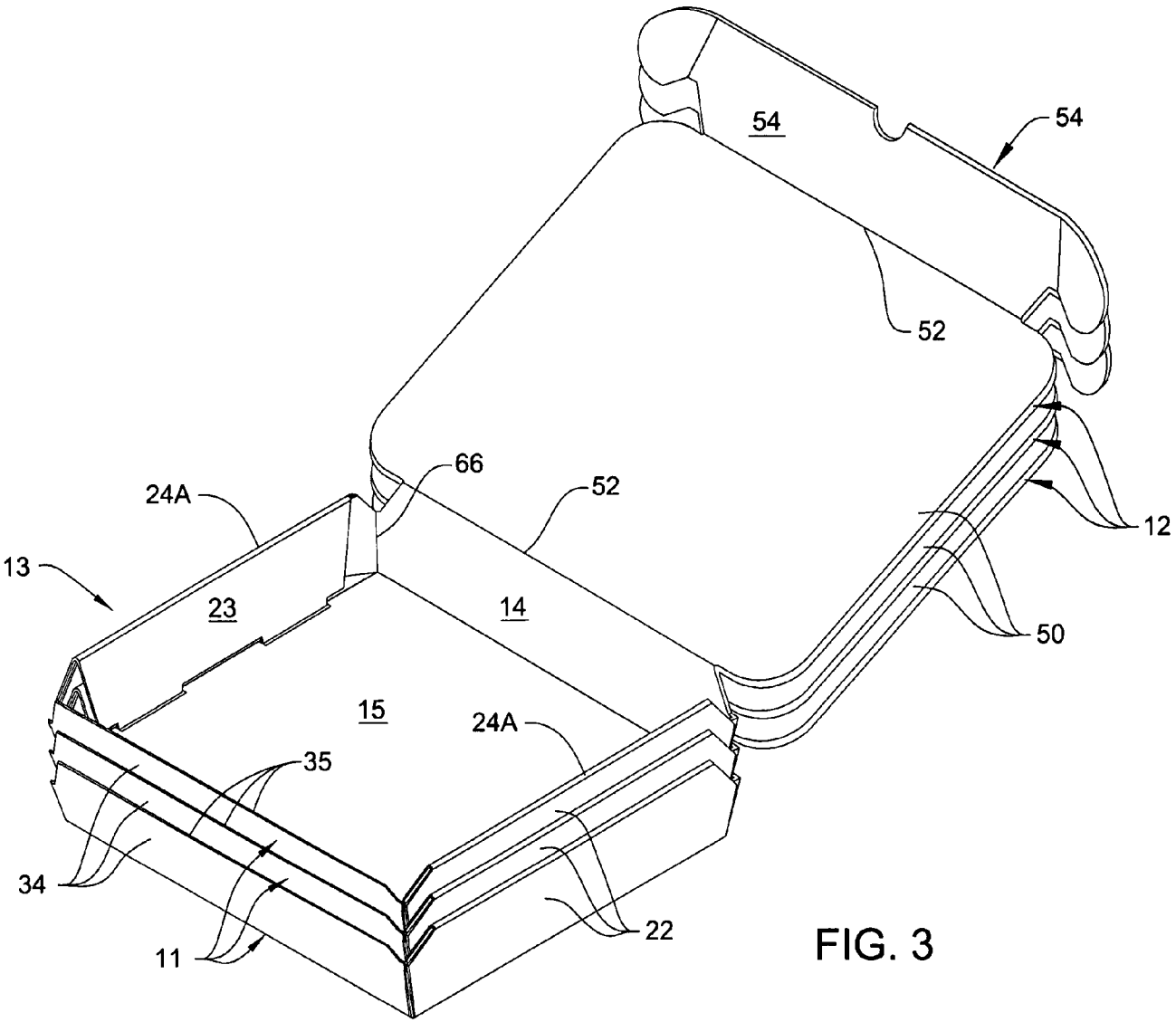
FIG. 3 shows a plurality of open, assembled containers in a nested or vertically stacked configuration.

The container 11 is now in a partially assembled condition as shown in FIG. 2, and due to the angled arrangement of the flaps 36 and 65 with respect to the rear base wall 14 and front wall 34, the sidewalls 80, front wall 34 and rear base wall 14 in their assembled positions taper outwardly as same project upwardly from bottom wall 15, and therefore enable a number of containers 11 to be stacked in a vertically nested manner one atop the other (FIG. 3).

In this partially assembled condition, a tray or container 70 may be placed on the bottom wall 15 of the uppermost container 11, and the container 11 may then be removed to a more convenient location for further assembly, or alternatively left atop the stack and further assembled thereat.

Figure 7:
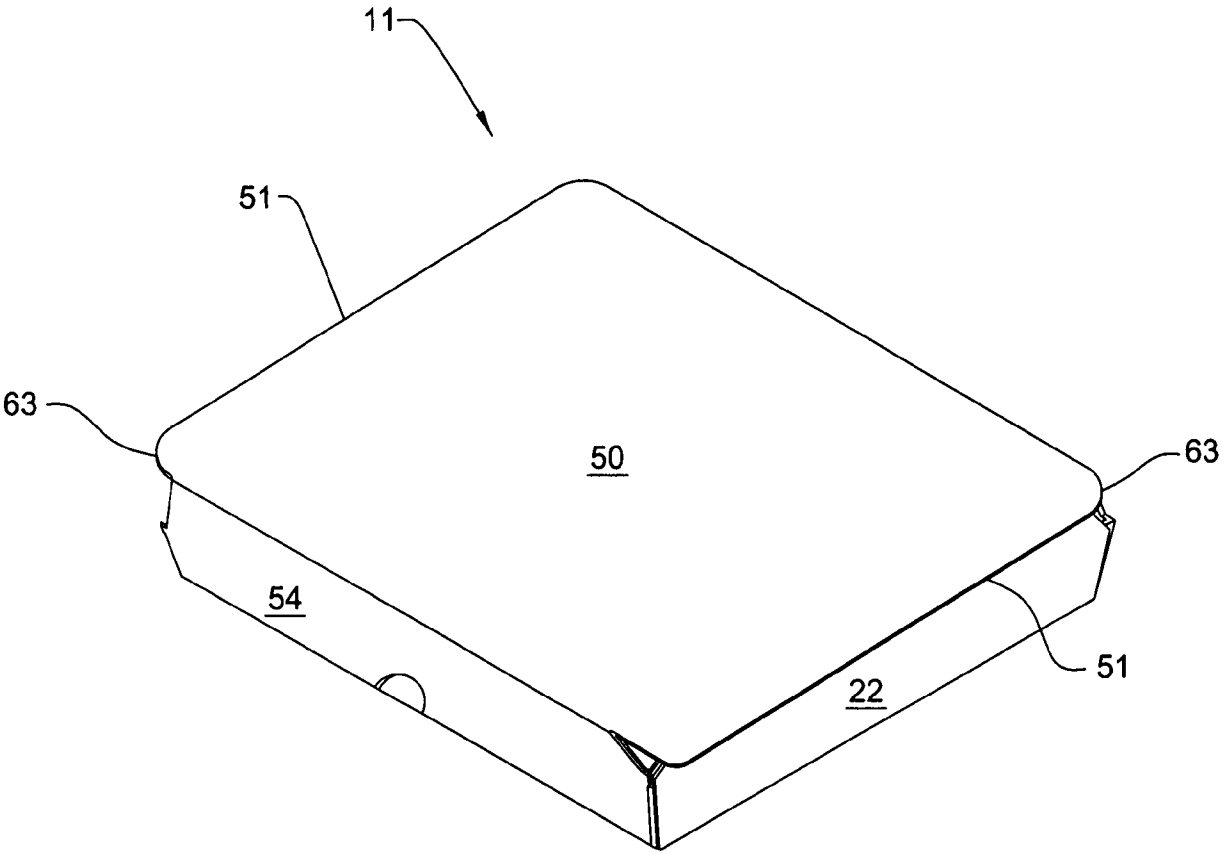
FIG. 7 is an overhead perspective view of the container in a closed configuration and with a food tray stored within the container.

To completely assemble or close the container 11, top wall 50 is folded downwardly about inner fold line 52. Top front flap 54 is then folded downwardly about outer fold line 52 and towards front wall 34. Locking flaps 61 are folded inwardly about their respective fold lines 62, and are tucked into the vertically-oriented slots 88 (FIG. 4) defined between the outer side surfaces of front flaps 36 and the opposed inner side surfaces of the respective inner sidewall parts 22, which effectively locks the top wall 50 in place relative to lower portion 13. FIG. 7 illustrates the container 11 in this fully closed condition.

The configuration of the container 11 provides same with a rigid construction which enables safe transport of the tray or container 70 stored therein. As such, the containers 11 may be safely stacked vertically upon one another in the fully assembled and closed condition for storage of food items prior to delivery, and also during delivery. Further, the container 11 further insulates the food item contained within tray 70, and thus helps to maintain the item at the desired temperature. In addition, and particularly when hot foods are being transported, the container 11 according to the invention provides safer handling of the food by utilizing a dual-container arrangement.

Figure 4A:
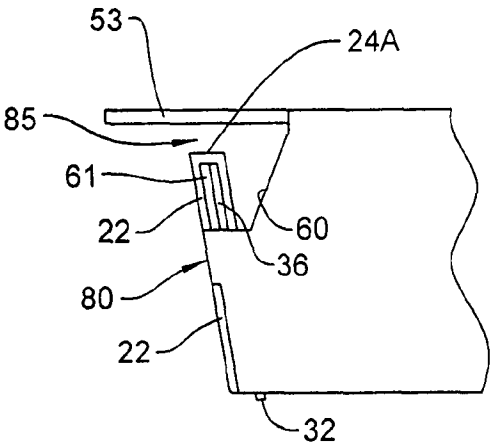
FIG. 4A is an elevational and fragmentary front view of the container in a closed configuration similar to FIG. 4, but without the food tray.

As shown in FIGS. 4-6, the container 11 is sized such that the lower portion of the tray 70 fits wholly within the lower portion 13 of container 11, while the flange 73 of tray 70 seats atop the uppermost edges 24A of the respective sidewalls 80. As such, the overall vertical height of assembled sidewalls 80 is less than the overall height of top wall 50 as measured from the upper surface of bottom wall 15, so as to define generally sidewardly-opening, horizontally-oriented and elongate slots 85 along the upper edges 24A of the respective assembled sidewalls 80 (see FIGS. 4 and 4A). As shown in FIG. 5, top wall 50, where same joins rear base wall 14 and top wall flap 54, surrounds flange 73 of tray 70 to prevent any significant shifting of tray 70 within container 11.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. An outer container for housing an inner storage container such as for transporting a food product therein, the inner storage container including a bottom, a generally upright sidewall projecting upwardly from the bottom, and a flange connected to the sidewall, said outer container comprising:

upper and lower portions joined to one another such that said upper portion is pivotable away from said lower portion to define an open configuration of said outer container and such that said upper portion of said outer container is pivotable toward said lower portion to define a closed configuration of said outer container, said upper portion of said outer container including a generally planar top wall;

said lower portion of said outer container including:

a generally planar bottom wall having a first pair of generally parallel side edges and a second pair of generally parallel side edges extending transversely relative to said first pair of side edges;

first and second elongate sidewalls joined to said bottom wall and extending upwardly therefrom along said first pair of side edges; and third and fourth elongate sidewalls joined to said bottom wall and extending upwardly therefrom along said second pair of side edges, said third and fourth sidewalls being oriented transversely relative to said first and second sidewalls;

said top wall having respective first and second edge portions which, when said outer container is in said closed configuration, are disposed adjacent to but in vertically-spaced relation from, respective first and second upper edge portions of said first and second sidewalls to define respective first and second generally sidewardly-opening slots, said first and second slots being unobstructed sidewardly by any part of said outer container such that a flange of an inner storage container engages in said first and second slots and projects sidewardly outwardly through said first and second slots when housed within said outer container, said top wall having a first pair of generally parallel side edges and a second pair of generally parallel side edges extending transversely relative to said first pair of side edges, said top wall mounting thereon a front locking flap joined to one of said side edges and foldable downwardly relative to said top wall for engagement with one of said third and fourth sidewalls to lock said upper portion to said lower portion in said closed configuration of said outer container.

2. The outer container of claim 1, wherein said third and fourth sidewalls are front and rear sidewalls, and said top wall is hingedly connected to said rear sidewall and swingably movable relative thereto to define said open and closed configurations of said outer container.

3. The outer container of claim 1, wherein said first and second sidewalls are each defined by a first sidewall part joined to said bottom wall along the respective said first side edge, and a second sidewall part joined to an outer edge of said first sidewall part, said second sidewall part being foldable downwardly about a fold line defined by said first sidewall outer edge and disposed in superimposed relation relative to said first sidewall part to provide said first and second sidewalls with a multi-layer construction.

4. The outer container of claim 3, wherein each said second sidewall part defines thereon a locking tab, and a locking slot is defined adjacent each said first side edge of said bottom wall, said locking tab of each said second sidewall part engaging within the respective said locking slot.

5. The outer container of claim 3, wherein said third and fourth sidewalls are front and rear sidewalls, and said top wall is hingedly connected to said rear sidewall and swingably movable relative thereto to define said open and closed configurations of said outer container, each of said front and rear sidewalls including a pair of flaps hingedly connected to opposite ends of the respective said sidewall and foldable inwardly relative thereto, said flaps of said front and rear sidewalls disposed adjacent said first sidewall being sandwiched between said first and second sidewall parts of said first sidewall, and said flaps of said front and rear sidewalls disposed adjacent said second sidewall being sandwiched between said first and second sidewall parts of said second sidewall.

6. The outer container of claim 1, wherein said outer container is formed entirely from a one-piece, monolithic, flat, sheet-like blank of stiff cardboard.

7. The outer container of claim 1, wherein said third and fourth sidewalls are front and rear sidewalls, said first pair of side edges of said top wall are disposed adjacent the respective said first and second sidewalls in said closed configuration of said outer container and define respective terminal edges of said first and second edge portions of said top wall, and said second pair of side edges of said top wall are disposed adjacent the respective said front and rear sidewalls in said closed configuration of said outer container, said top wall is hingedly joined to said rear sidewall along a rear one of said second pair of side edges of said top wall, and said front locking flap is hingedly joined to said top wall along a front one of said second pair of side edges.

8. The outer container of claim 1, wherein said first and second edge portions and said top wall are all coplanar with one another, and said first and second edge portions project sidewardly outwardly beyond respective generally upright and adjacent surfaces of said first and second sidewalls.

9. The outer container of claim 1, wherein said first, second, third and fourth sidewalls angle outwardly as same project upwardly from said bottom wall to permit vertical nesting of a plurality of said outer containers.

10. The outer container of claim 1, wherein said first and second slots extend along substantially the entire extent of said first and second upper edge portions of said first and second sidewalls and open sidewardly in a direction substantially parallel to respective planes in which said bottom wall and said top wall are disposed.

11. The outer container of claim 1, wherein said first and second slots have a longitudinal dimension which corresponds substantially to a distance defined between said third and fourth sidewalls.

12. The outer container of claim 1, wherein said first and second slots open sidewardly-outwardly towards, and communicate with, an exterior of said outer container in a plane substantially parallel to a plane in which said bottom wall is disposed.

13. The outer container of claim 1, wherein said first and second edge portions of said top wall and a part of said top wall extending between said first and second edge portions of said top wall are all coplanar with one another.

14. A one-piece, monolithic blank which is foldable to form an outer container for housing an inner container having a bottom, a generally upright wall structure and a flange connected to an upper edge portion of the wall structure and oriented transversely relative thereto, said blank comprising:

a base wall having a first pair of generally parallel side edges and a second pair of generally parallel side edges extending transversely relative to said first pair of side edges;

first and second elongate sidewalls joined to said base wall via fold lines defined along the respective first pair of said side edges;

third and fourth elongate sidewalls joined to said base wall via fold lines defined along the respective second pair of said side edges; and a top wall having a first pair of generally parallel side edges and a second pair of generally parallel side edges extending transversely relative to said first pair of side edges, one of said side edges of said top wall being joined to an outer edge of said first sidewall via a fold line;

said first, second, third and fourth sidewalls being foldable upwardly from said base wall about their respective fold lines into generally upright positions, a dimension defined between said fold line joining said one side edge of said top wall to said first sidewall and said fold line joining said first sidewall to said base wall being greater than respective dimensions defined between outer terminal edges of said third and fourth sidewalls and the respective fold lines joining said third and fourth sidewalls to said base wall, such that when said top wall is folded downwardly from said first sidewall about the respective fold line and into a closed position generally parallel to said base wall, said top wall is spaced vertically upwardly from the respective said outer terminal edges of said third and fourth sidewalls when in their generally upright folded positions to define respective sidewardly-opening slots for receiving a flange of an inner container when disposed within said outer container, said top wall mounts thereon a locking flap joined via a fold line to said side edge of said top wall parallel to said one side edge of said top wall, said locking flap being foldable downwardly from said top wall for engagement with said third and fourth sidewalls.

15. The blank of claim 14, wherein said third and fourth sidewalls are each defined by a first sidewall part joined to said base wall along the respective fold line defined along the respective said second side edge, and a second sidewall part joined to an outer edge of said first sidewall part via a fold line about which said second sidewall part is foldable downwardly and disposable in superimposed relation with said first sidewall part to provide said third and fourth sidewalls with a multi-layer construction in the folded configuration of the blank, said fold lines about which said second sidewall parts are folded downwardly defining the respective said outer terminal edges of said third and fourth sidewalls, said outer terminal edges of said third and fourth sidewalls being spaced downwardly from said top wall in said closed position.

16. The blank of claim 15, wherein each said second sidewall part defines thereon a locking tab, and a locking slot is defined adjacent each said second side edge of said base wall, said locking tabs engaging within the respective said locking slots in the folded positions of said third and fourth sidewalls.

17. The blank of claim 14, wherein said first and second sidewalls include a pair of flaps hingedly connected to opposite ends of the respective said sidewall and foldable inwardly relative thereto, said flaps of said first and second sidewalls disposed adjacent said third sidewall being sandwiched between said first and second sidewall parts thereof in the folded configuration of said blank, and said flaps of said first and second sidewalls disposed adjacent said fourth sidewall being sandwiched between said first and second sidewall parts thereof in the folded configuration of said blank.

18. The blank of claim 14, wherein said locking flap includes a pair of locking tabs connected to opposite ends of said locking flap via respective fold lines, each said locking tab being foldable inwardly and positioned between the adjacent said first sidewall part and the adjacent said flap of said second sidewall.

19. The blank of claim 14, wherein said slots, in the folded configuration of said blank, open sidewardly-outwardly towards, and communicate with, an exterior of said blank in the folded configuration thereof.

* * * * *